US007966703B2

(12) United States Patent
Ubiñana Felix

(10) Patent No.: US 7,966,703 B2
(45) **Date of Patent: *Jun. 28, 2011**

(54) CLAMP FOR SECURING SHUTTERING PANELS

(75) Inventor: José Luis Ubiñana Felix, Parets Del Valles (ES)

(73) Assignee: Sistemas Tecnicos de Encofrados, S.A., Parets del Valles (Barcelona) (ES)

( * ) Notice: Subject to any disclaimer, the term of this patent is extended or adjusted under 35 U.S.C. 154(b) by 630 days.

This patent is subject to a terminal disclaimer.

(21) Appl. No.: 11/909,338

(22) PCT Filed: Apr. 10, 2006

(86) PCT No.: PCT/ES2006/000171

§ 371 (c)(1),
(2), (4) Date: Sep. 21, 2007

(87) PCT Pub. No.: WO2006/108893

PCT Pub. Date: Oct. 19, 2006

(65) Prior Publication Data

US 2010/0024176 A1 Feb. 4, 2010

(30) Foreign Application Priority Data

Apr. 11, 2005 (ES) ..... 200500832

(51) Int. Cl.
*E04B 1/38* (2006.01)

(52) U.S. Cl. ..... 24/514; 269/90; 269/218; 81/487

(58) Field of Classification Search ..... 24/514, 24/489, 513, 569; 81/487, 350; 269/85, 269/90, 218, 236; 294/106; 70/17; 248/229.13, 248/229.14, 229.15, 229.1, 226.11, 228.5
See application file for complete search history.

(56) References Cited

U.S. PATENT DOCUMENTS

| | | | | | |
|---|---|---|---|---|---|
| 278,385 | A | * | 5/1883 | Adams | 12/103 |
| 815,907 | A | * | 3/1906 | Davis | 600/203 |
| 863,298 | A | * | 8/1907 | Malcolm | 70/17 |
| 887,103 | A | * | 5/1908 | Lane | 269/156 |
| 919,971 | A | * | 4/1909 | Smith | 269/160 |
| 1,290,520 | A | * | 1/1919 | Crocker | 81/487 |
| 1,709,385 | A | * | 4/1929 | Young | 269/156 |
| 2,432,139 | A | * | 12/1947 | Crowley | 156/580 |
| 2,543,017 | A | * | 2/1951 | Hagan | 294/106 |
| 2,851,913 | A | * | 9/1958 | Ramoneda | 269/127 |
| 2,915,096 | A | * | 12/1959 | Mooney | 269/157 |
| 3,306,646 | A | * | 2/1967 | Flora, Jr. | 294/2 |
| 3,331,111 | A | * | 7/1967 | Carver | 24/514 |
| 3,810,294 | A | * | 5/1974 | Link | 29/261 |
| 3,984,798 | A | * | 10/1976 | Bussen | 336/176 |

(Continued)

FOREIGN PATENT DOCUMENTS

DE 10047203 6/2001

(Continued)

*Primary Examiner* — Robert J Sandy
*Assistant Examiner* — Rowland D Do
(74) *Attorney, Agent, or Firm* — Birch, Stewart, Kolasch & Birch, LLP

(57) ABSTRACT

The clamp comprises two substantially L-shaped members, arranged opposite each other, articulated on an intermediate support on which rest the lateral profile sections of the frames of the panels to be clamped, one of the arms of each of the L-shaped members having an end profile adapted for its coupling to the profile sections to be clamped, while the other arm of each of said L-shaped members receives a displacement action in order to effect its rotation from a mechanism incorporated in the intermediate support, intended to effect the opening and closing of the L-shaped members of the clamp.

6 Claims, 9 Drawing Sheets

U.S. PATENT DOCUMENTS

| | | | | |
|---|---|---|---|---|
| 5,146,816 | A * | 9/1992 | Badstieber | 81/487 |
| 5,570,500 | A * | 11/1996 | Merkel | 24/495 |
| 7,249,399 | B2 * | 7/2007 | Taylor | 24/505 |

FOREIGN PATENT DOCUMENTS

| | | |
|---|---|---|
| DE | 10028556 | 9/2001 |
| EP | 201887 | 11/1986 |
| EP | 580537 | 1/1994 |
| ES | 2019058 | 5/1990 |
| ES | 2085694 | 5/1994 |
| ES | 2063635 | 1/1995 |
| ES | 2118306 | 9/1995 |
| ES | 2245264 | 12/2005 |
| GB | 191404721 | 2/1915 |

* cited by examiner

CLAMP FOR SECURING SHUTTERING PANELS

CROSS-REFERENCE TO RELATED APPLICATIONS

This application is a 371 National Phase of International Application No. PCT/ES2006/000171, filed Apr. 10, 2006, which claims priority under 35 U.S.C. §119 to Spanish Application No. 200500832 filed Apr. 11, 2005, both of which are hereby incorporated by reference in their entireties.

BACKGROUND OF THE INVENTION

The present invention is intended to disclose a clamp for securing shuttering panels which has substantial characteristics of novelty and inventive step.

As is known, in order to produce shuttering surfaces for walls it is necessary to place shuttering panels for walls one beside the other, securing them to one another by means of clamps of various types.

Clamps are known which are of the type that use wedges which are fitted by pressure, and other types of clamps in which, for the arrangement of inclined planes, there are members which produce a compressing action between the adjacent members of the frames of two adjacent shuttering panels.

SUMMARY OF THE INVENTION

The present invention is intended to disclose a clamp for securing shuttering panels for walls which is functionally highly efficient and simply constructed, simultaneously obtaining a simple, solid and economic construction, and also being very effective in its application.

Basically, the clamp of the present invention consists fundamentally of two parts forming the securing arms of the clamp which are identical to each other, generally L-shaped, an intermediate support and rotation member and a threaded tensioning rod with which is associated a quick-fix butterfly nut, or alternatively a transverse displacement wedge.

All the parts, except for the threaded rod and the rotation pivots, are produced by pressing and cutting methods, so that great manufacturing economy is obtained.

The two parts forming the arms of the clamp are generally L-shaped, articulated with each other by the ends of the horizontal arms and rotatable about respective points close to the vertices of the L-shape on pivots which pass through an intermediate support member, preferably tubular. The opening and closing of the arms of the L-shaped members is achieved by the screwing or unscrewing of a wing nut coupled on the threaded rod, or by the introduction of a transverse wedge.

The L-shaped parts have double arms, defining an intermediate space for receiving the intermediate articulation support.

BRIEF DESCRIPTION OF THE DRAWINGS

For a greater understanding thereof, some drawings of a preferred embodiment of the present invention are appended by way of a non-limiting example, wherein.

DETAILED DESCRIPTION OF THE INVENTION

Figure 3:
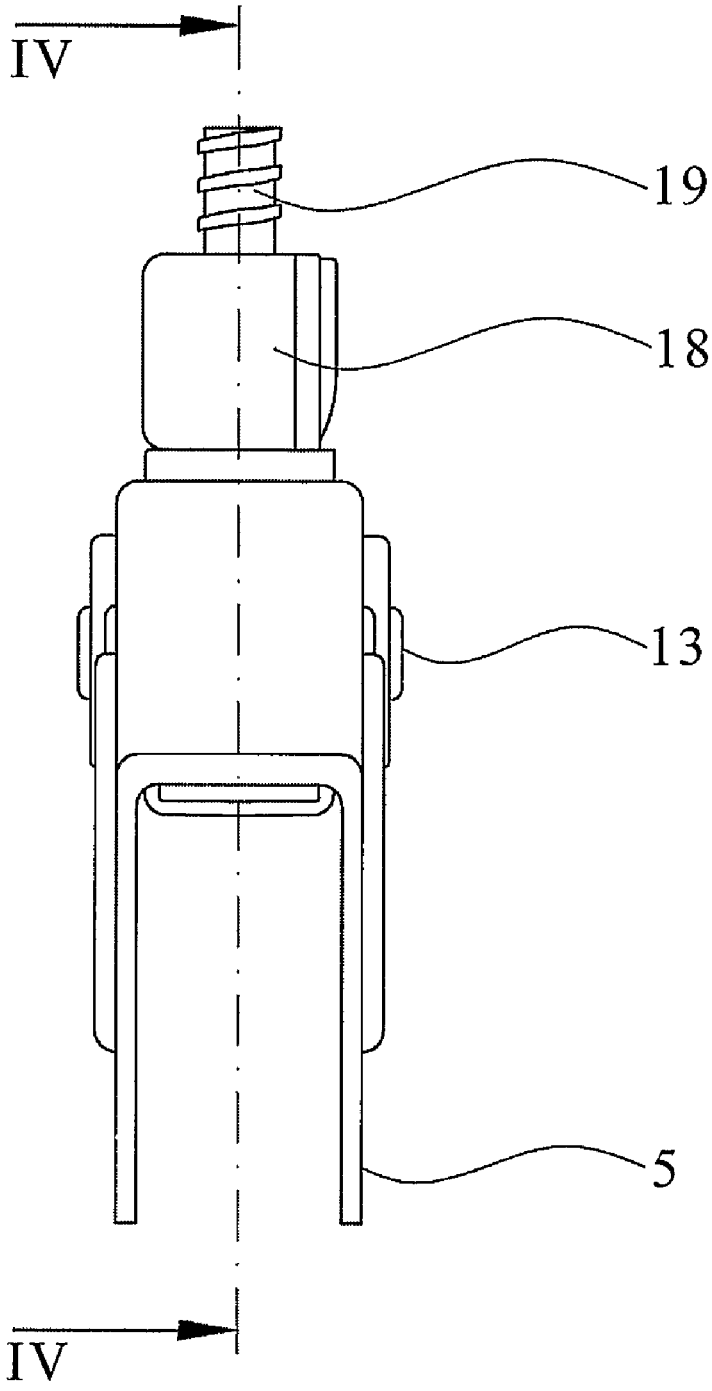
FIGS. 3 and 4 are respectively a view in elevation from one end and a view in front elevation of a clamp according to the invention.

As can be seen in the drawings, the clamp of the present invention comprises two approximately L-shaped members 1 and 2, each of which has pairs of active arms, respectively 3 and 4, carrying the protuberances 5 and 6 intended to fit into the recesses 7 and 8 of the profile sections, customarily tubular, which form the frames for respective adjacent shuttering panels 9 and 10 which are to be joined by means of the clamp. The double arm structure on each member of the L-shape can be seen more easily in FIGS. 3 and 5.

Figure 1:
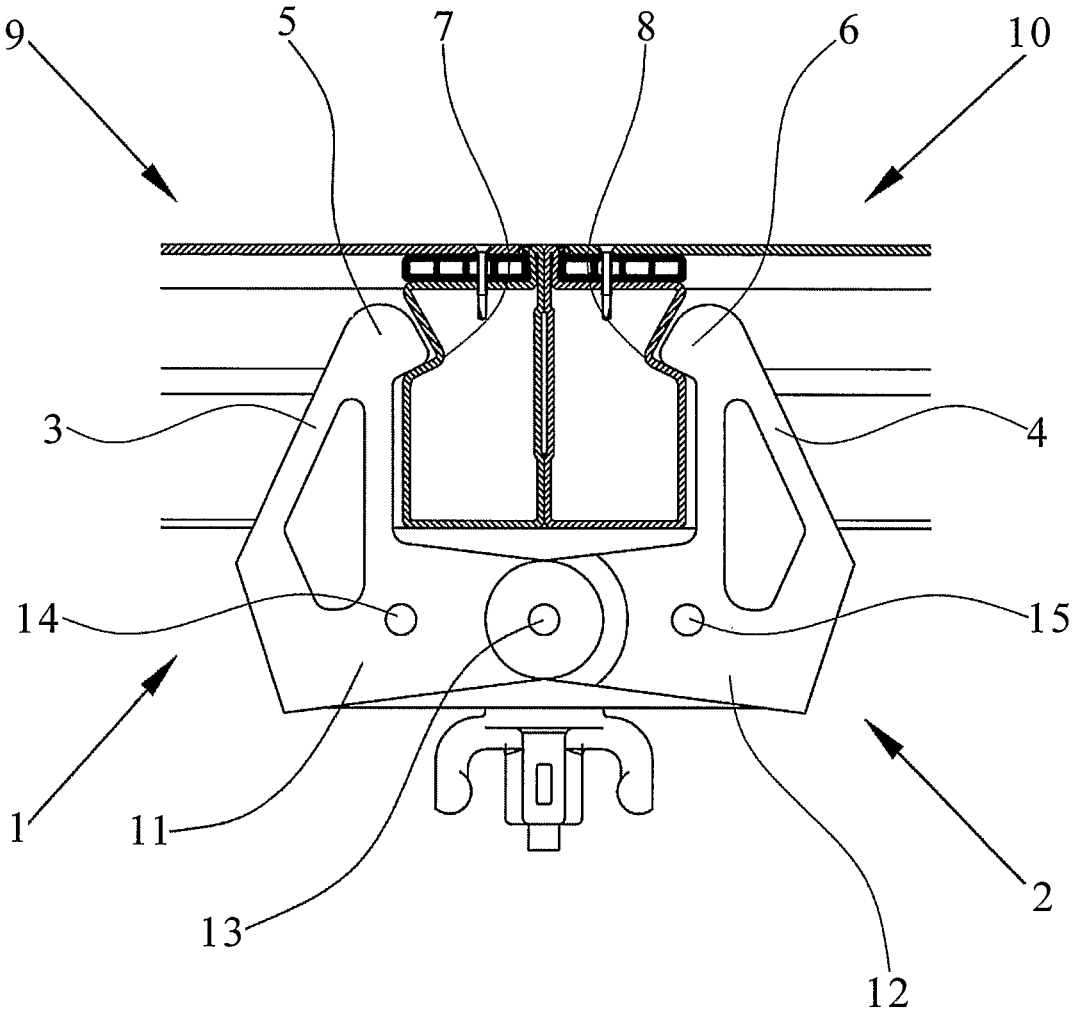
FIG. 1 shows a view in front elevation of a clamp fitted on two profile sections of respective adjacent shuttering panels, with section of said profiles.
Figure 2:
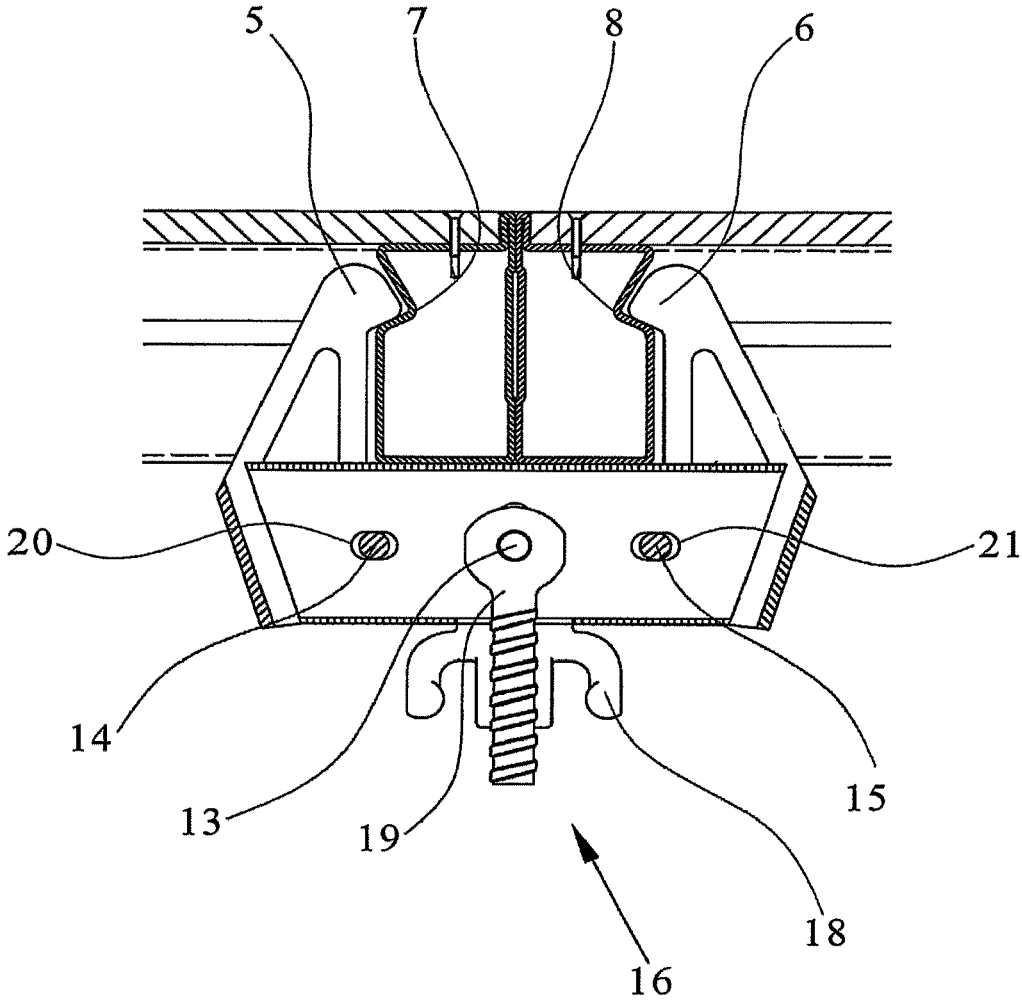
FIG. 2 is a view similar to FIG. 1 in which can be seen a complete section of the members forming the clamp.

In a first embodiment, both members 1 and 2 have respective joining arms 11 and 12 articulated with one another by means of a transverse pin 13 and articulated by means of pins 14 and 15 with an intermediate support member of preferably tubular structure 16, FIG. 2, contained within the space defined by the double parallel arms of the L-shaped members.

The rotation of the members 1 and 2 on the transverse pins 14 and 15 makes it possible to tighten and release the clamp, thereby securing the profile sections 9 and 10 of the shuttering panels or releasing same for their dismantling.

The displacement of the members 1 and 2 of the clamp is effected by means of the actuation of a threaded rod 17 on which acts a quick-action butterfly nut 18. The threaded rod 17 surrounds with its end or head 19 the pivot pin 13 which is also articulated on the intermediate tubular member 16.

The openings 20 and 21 of the intermediate support 16 on which the pins 14 and 15 are articulated are slightly elongated, in order to permit not only the rotation of the clamp members 1 and 2, but also the satisfactory alignment of the points of attack of the protuberances 5 and 6 with respect to said pivot pins, thus avoiding offset stresses.

Figure 4:
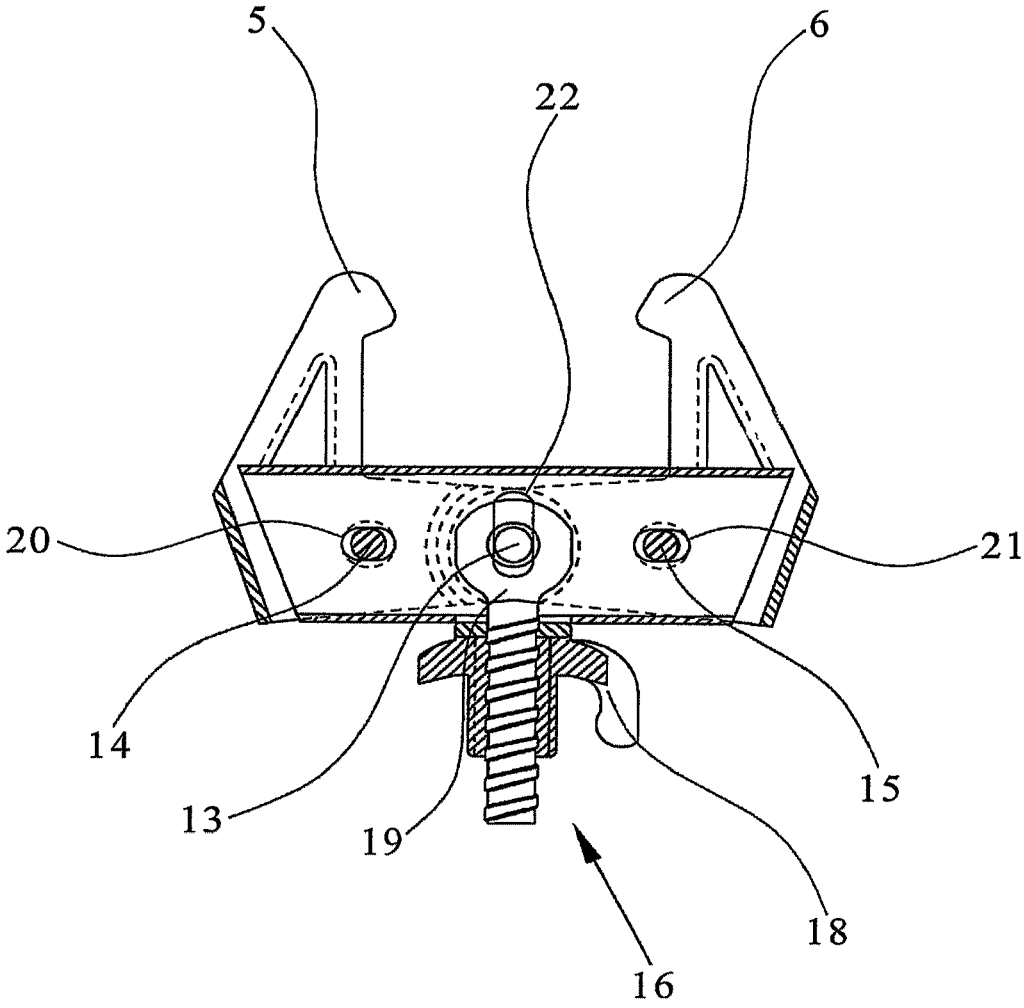

Likewise, the opening of the intermediate support 16 in which the pin 13 is articulated and which is designated by the number 22 in FIG. 4, is likewise elongated vertically in order to permit slight displacement and the action of compression of the rod 17.

Figure 6:
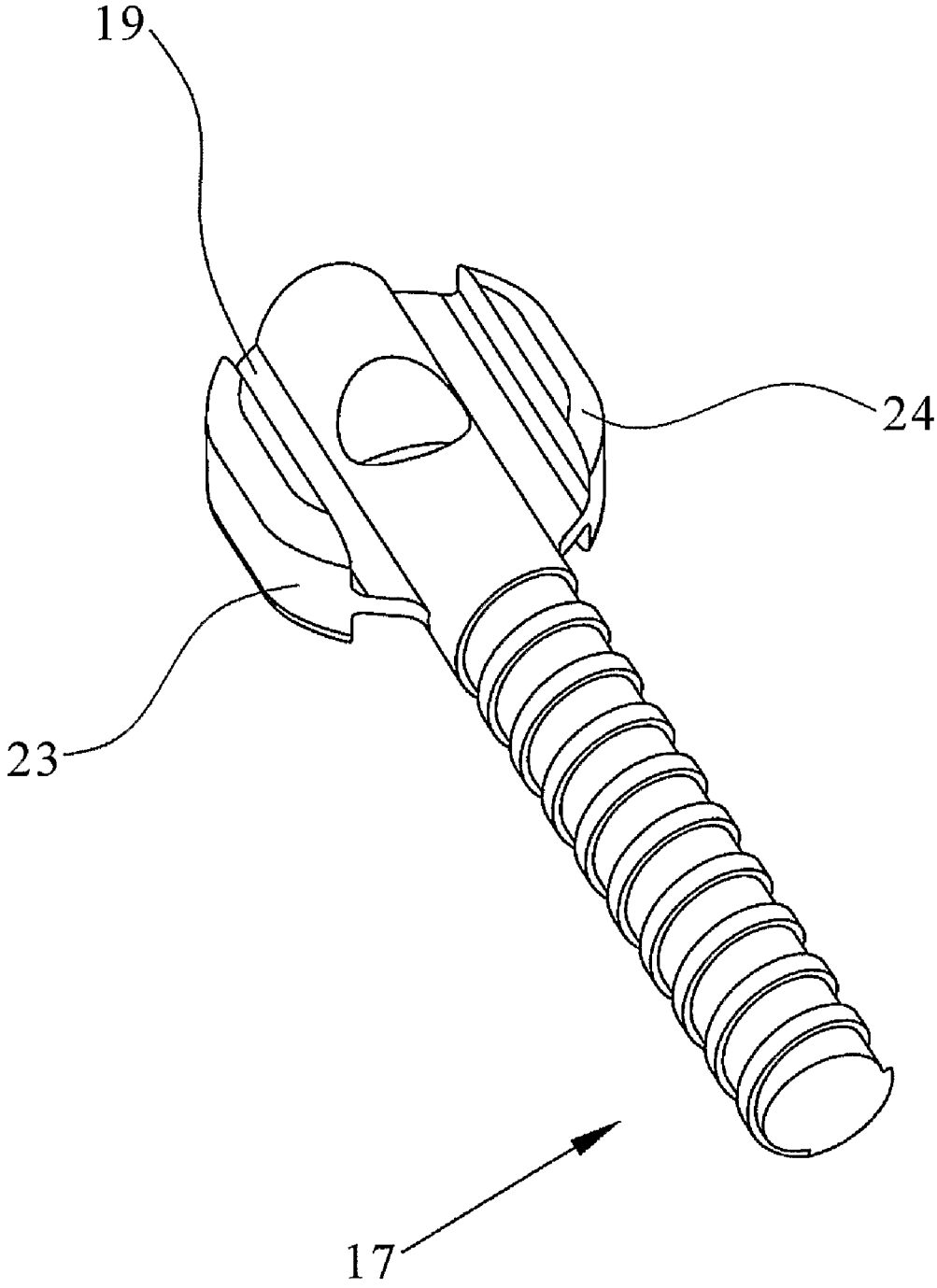
FIG. 6 shows a view of the threaded rod and head carrying the transverse pivot pin.

As can be seen in FIG. 6, the rod 17 has its end head 19 equipped with an opening for the pin 13 and respective lateral expansions substantially T-shaped in cross-section 23 and 24.

By means of the explained constitution of the clamp of the present invention, the result obtained is that the clamp is produced simply by three basic members, that is, the L-shaped double arms 1 and 2 and the inner tubular support member 16, being complemented simply by the threaded rod 17 and the butterfly nut 18. The transverse pivot pins 13, 14 and 15 are clinched for the purpose of greater simplicity, providing a clamp which requires a minimum number of parts for its operation and which does not require any welding of parts such as is customary at present. This latter characteristic, besides simplifying and reducing the cost of the manufacture of the clamp, permits the manufacture of same by means of sheet-metal members which may previously have been provided with an anti-corrosion surface treatment, since, not having had any welding work, it does not subsequently require specific anti-corrosion treatment.

Figure 5:
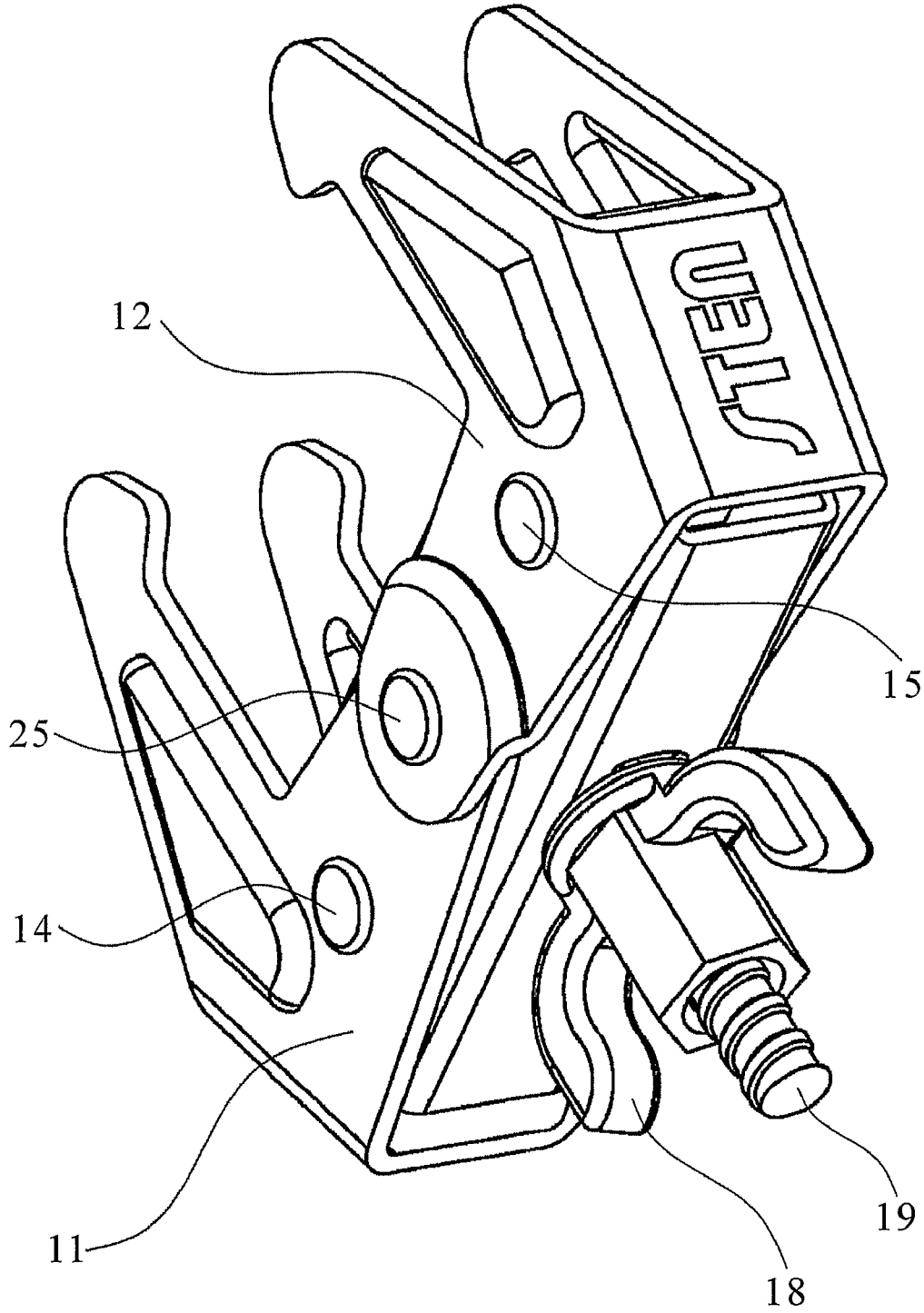
FIG. 5 shows a perspective view of the clamp.

In addition, the members 1 and 2 are identical and are simply displaced on their articulation, which means no functional inconvenience. For this the end regions of the arms 11 and 12 are overlapped as can be seen in FIG. 5, in which it can be seen that one of the arms, for example the arm 12, has a slight end pressing 25 so as to overlap with the coincident end of the other articulated arm 11.

Figure 7:
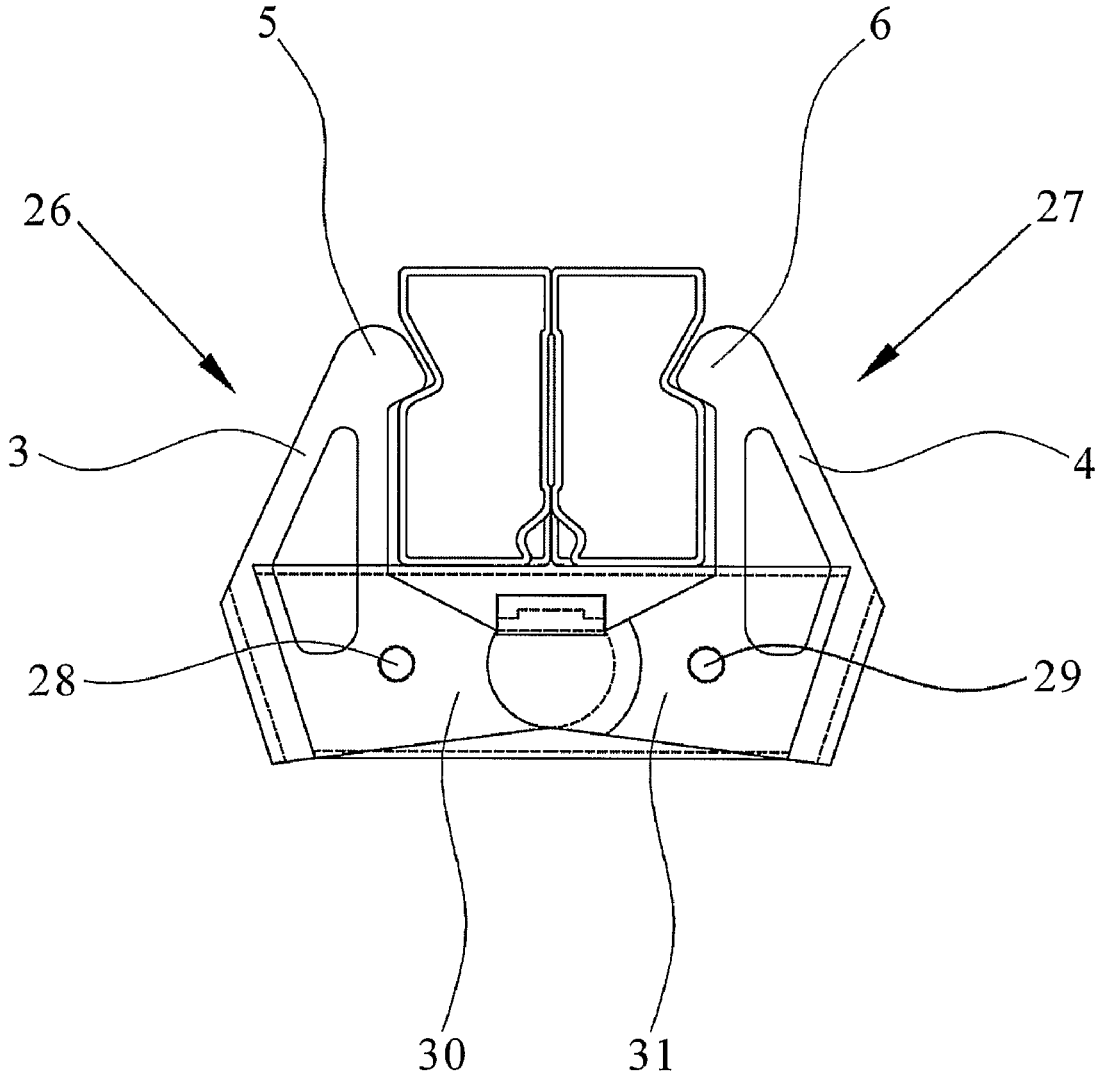
FIGS. 7, 8 and 9 show respective details of a second embodiment of the clamp with actuating wedge.
Figure 8:
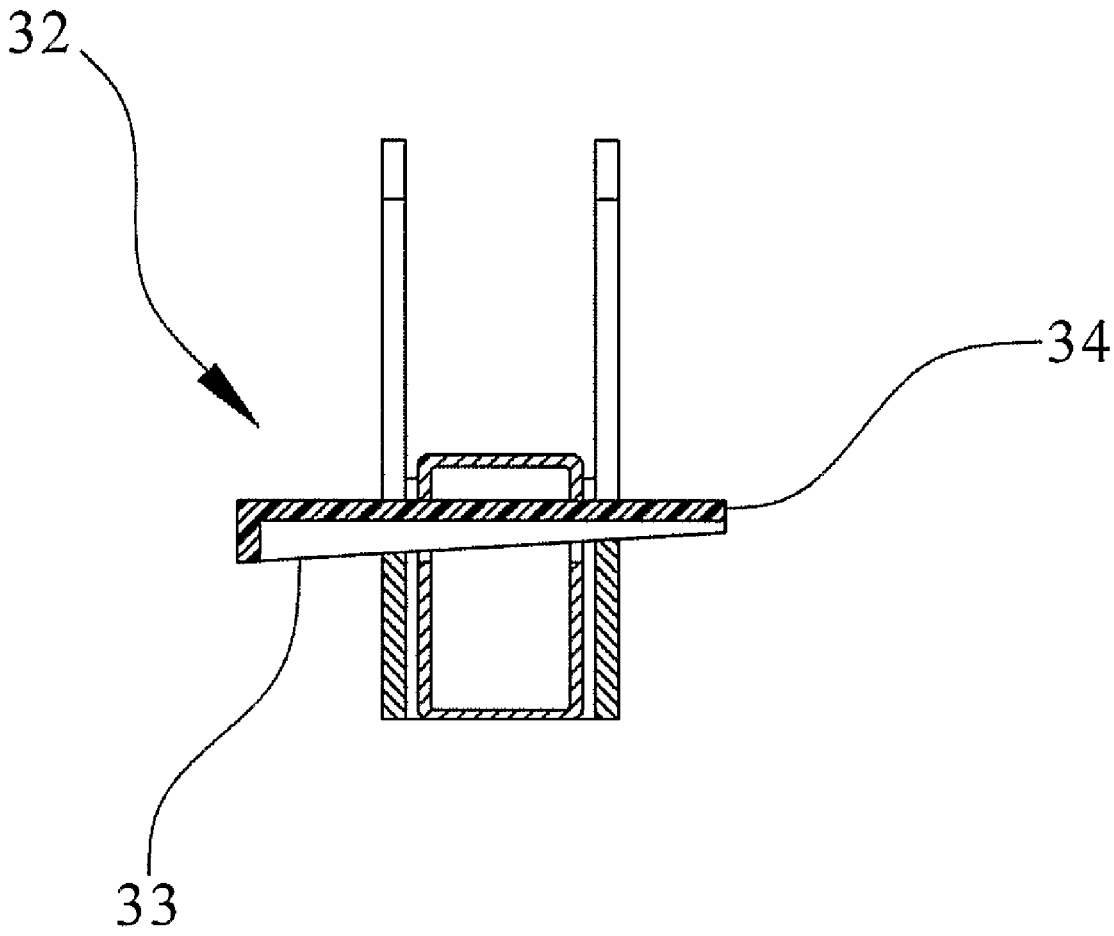
Figure 9:
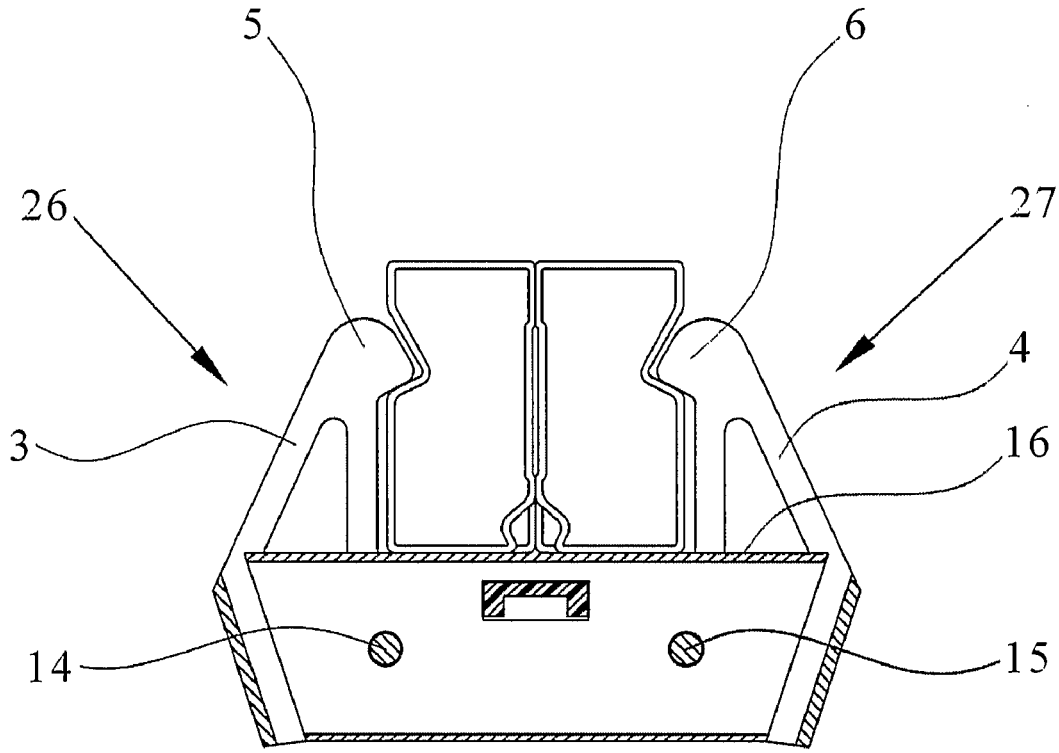

In the variant shown in FIGS. 7 to 9, the L-shaped members 26 and 27 have transverse openings for respective pivot pins 28 and 29, there being no elongated holes. The ends of the arms 30 and 31 are simply overlapped and the actuation thereof in order to effect the rotation of said arms 26 and 27 and, therefore, the actuation of the clamp, is carried out by means of a transverse wedge 32 which acts by its lower inclined plane 33 on the upper edges of said arms 30 and 31, effecting their vertical displacement, the result of which is the rotation of the members 26 and 27 respectively on the pins 28 and 29.

In order to prevent the wedge 32 from coming out, it may have a stop of some type on its end 34, produced after its introduction into the clamp.

The invention claimed is:

1. A clamp comprising two substantially L-shaped members, arranged opposite each other, articulated on an intermediate support and operatively connected to lateral profile sections of frames of panels to be clamped, one of the arms of each of the L-shaped members having an end profile adapted for its coupling to the profile sections to be clamped, while the other arm of each of said L-shaped members receives a displacement action in order to effect its rotation from a mechanism incorporated in the intermediate support, intended to effect the opening and closing of the L-shaped members of the clamp, which move simultaneously, wherein the intermediate support is traversed by respective elongated openings for receiving respective pivot pins for articulating each of the L-shaped members of the clamp, and wherein the actuation of the L-shaped members of the clamp is effected by means of the axial displacement of a threaded rod having a head which is traversed by a pin for a second articulation of both L-shaped members with each other, the pin also traversing the intermediate support of the clamp through an elongated opening parallel with the axis of the threaded rod.

2. The clamp according to claim 1, wherein the intermediate support receiving the profile sections to be clamped by the clamp is constituted by a tubular member with the ends bevel-cut.

3. The clamp according to claim 1, wherein each of the L-shaped members of the clamp is double, with two pairs of arms parallel to one another, equipped with reinforcing ribs, ending in protuberances for coupling to the lateral profile sections of shuttering panels to be clamped and the other two arms respectively surrounding sides of the intermediate support.

4. The clamp according to claim 1, wherein the L-shaped members are identical to one another and are each produced in one piece from sheet metal by cutting and pressing.

5. The clamp according to claim 1, wherein ends of both L-shaped members which receive the displacement action in order to effect their rotation, are superposed by means of complementary pressings.

6. The clamp according to claim 1, wherein the threaded rod has coupled on it a wing nut for adjusting its axial position by abutment on the intermediate support.

* * * * *